US007059764B2

(12) United States Patent
Hintze et al.

(10) Patent No.: US 7,059,764 B2
(45) Date of Patent: Jun. 13, 2006

(54) DEVICE FOR THE FINE ADJUSTMENT OF A BALANCE WHEEL/HAIRSPRING

(75) Inventors: Hans-Georg Hintze, Dippoldiswalde (DE); Mathias Schneider, Dunningen (DE)

(73) Assignee: Glashütter Uhrenbetrieb GmbH, Glashütte/Sachsen (DE)

( * ) Notice: Subject to any disclaimer, the term of this patent is extended or adjusted under 35 U.S.C. 154(b) by 0 days.

(21) Appl. No.: 10/539,007

(22) PCT Filed: Dec. 3, 2003

(86) PCT No.: PCT/EP03/13647

§ 371 (c)(1),
(2), (4) Date: Jun. 15, 2005

(87) PCT Pub. No.: WO2004/057427

PCT Pub. Date: Jul. 8, 2004

(65) Prior Publication Data

US 2006/0062088 A1 Mar. 23, 2006

(30) Foreign Application Priority Data

Dec. 19, 2002 (EP) ..... 02080621

(51) Int. Cl.
*G04B 15/00* (2006.01)
*G04B 17/04* (2006.01)
*G94B 17/00* (2006.01)

(52) U.S. Cl. ..... 368/127; 368/169; 368/173; 368/175

(58) Field of Classification Search ..... 368/127, 368/168–178
See application file for complete search history.

(56) References Cited

U.S. PATENT DOCUMENTS

| | | | | |
|---|---|---|---|---|
| 3,429,119 | A * | 2/1969 | Tamuru | 368/176 |
| 3,745,763 | A * | 7/1973 | Zaugg | 368/176 |
| 4,201,042 | A * | 5/1980 | Visconti et al. | 368/170 |
| 6,609,822 | B1 * | 8/2003 | Tokoro et al. | 368/171 |

FOREIGN PATENT DOCUMENTS

| | | |
|---|---|---|
| CH | 368 098 | 11/1962 |
| CH | 502 623 | 8/1970 |

* cited by examiner

*Primary Examiner*—Vit W. Miska
(74) *Attorney, Agent, or Firm*—Sughrue Mion, PLLC

(57) ABSTRACT

In order particularly to put a watch into beat and adjust the isochronism, in addition to the poising screws (2*a*, 2*b*) of the balance (1) and the fine adjusting screw (7) pressing on the index tail 20*a* to alter the orientation of the index (20), the device includes, on the one hand, two screws (19, 29) respectively fixed in the balance cock (10) and in the index (20) to maneuver clamps by means of L-shaped rocking elements (13, 23) to fix the end of the balance spring and define its useful length, and on the other hand, a screw (9) for immobilizing the index (20) in a determined position, these three screws (9, 19, 29) enabling a fine adjustment to be carried out.

8 Claims, 3 Drawing Sheets

DEVICE FOR THE FINE ADJUSTMENT OF A BALANCE WHEEL/HAIRSPRING

The present invention concerns fine regulating device for a sprung balance consisting in a particular arrangement of the index assembly to make adjusting the isochronism easier and more reliable in the long term. The invention also concerns a fine adjusting method, i.e. a succession of manipulations ranging from putting the watch into beat to the final adjustment, the initial and final manipulations being carried out by means of a single fine adjusting device owing to said particular arrangement.

In a known manner, an index assembly is made up of a set of parts mounted on the balance-cock, namely a balance-spring stud for securing the end of the outer curve of the balance-spring, and an index friction fitted onto the top balance endpiece comprising an extension beyond the balance-cock for the pins and/or the balance-spring buckle and at the other end a tail of the index on which a screw generally acts, against the return force of a spring, to rotate the index through small angles and thus modify the active length of the balance-spring.

The construction of the index assembly has given rise to a certain number of variants and improvements, particularly as regards the means for securing the external end of the balance-spring, and delimiting the active length of said balance-spring.

All of these constructions have in common the fact that the adjusting or securing means are generally complicated, which can make the adjusting operations difficult, particularly the fine adjustment of the isochronism.

It is thus an object of the invention to overcome the drawbacks of the prior art by providing a device that is much easier to handle owing to a particular arrangement of tightening/locking devices for adjusting the setting into beat and the rate by means of a single fine adjusting device. This arrangement also saves the use of a mobile stud-carrier for adjusting the setting into beat.

The invention therefore concerns a fine adjusting device for a sprung-balance. The balance, which, in a conventional manner, comprises poising screws screwed into its arms, has its axis pivoted between a plate and a balance-cock, whose top balance endpiece allows the friction fit mounting of an index that can be oriented, for example by means of a adjusting screw pressing onto the tail of the index against the return force of a spring. The balance-spring, pinned up to the collet in accordance with known means on the balance staff can be put into beat, adjusted as regards isochronism and have its outer curve fixed, owing to the fine adjusting screw and specific tightening/locking means on the balance cock and index whose features are explained hereinafter. The balance cock is provided with a first lug extended by a bent stirrup whose feet extend as far as the outer curve of the balance spring and in which a first tightening device is hinged formed of an L shaped rocking element the small arm of which is manoeuvred by a flanged screw screwed into said lug to make the large arm pivot and to form a clamp for the end of the balance spring with the inner surface of the stirrup feet. The index comprises, on an extension opposite the index tail, a second tightening device having the same design as the first, namely a stirrup in which an L shaped rocking element is hinged, whose flanged screw forms a clamp, by being screwed in, for fixing a chosen location of the curve outside the balance spring in order to delimit the useful length thereof. The balance cock includes finally a second lug into which a third screw is screwed through an oblong aperture in an annular tongue extending on one side the extension of the index, said screw locking the index in a pre-determined position by screwing in/unscrewing the fine adjusting screw. The axis of all three tightening/locking screws is parallel to the balance staff and they are all accessible from the same side of the device, which facilitates the adjustment operations.

This construction also has the advantage of being able to exert a defined tightening force on the outer curve of the balance spring, substantially perpendicular to the buckle, and not causing any deformation of the latter while giving the surfaces opposite the clamps formed by a stirrup and an L-shaped rocking element the same curvature as that of the outer curve of the balance spring.

Other features and advantages of the present invention will appear in the following description, given by way of illustrating and non-limiting example, with reference to the annexed drawings, in which.

Figure 1:
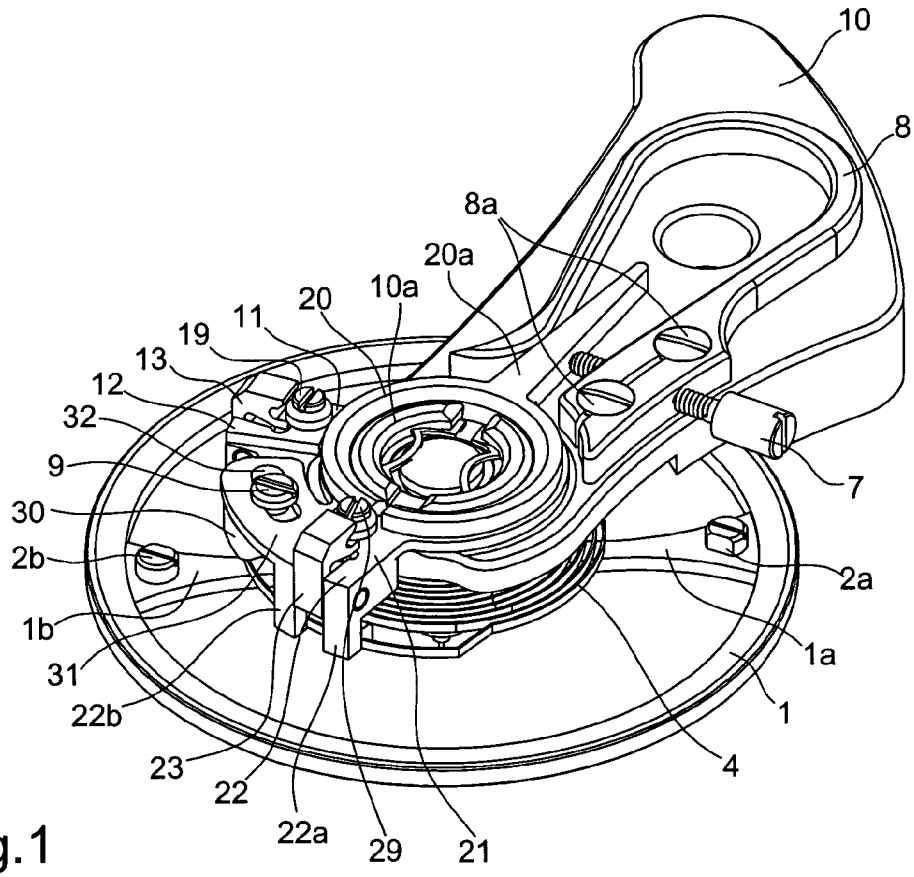
FIG. 1 is a top perspective view of a sprung balance according to a first embodiment of the invention.
Figure 2:
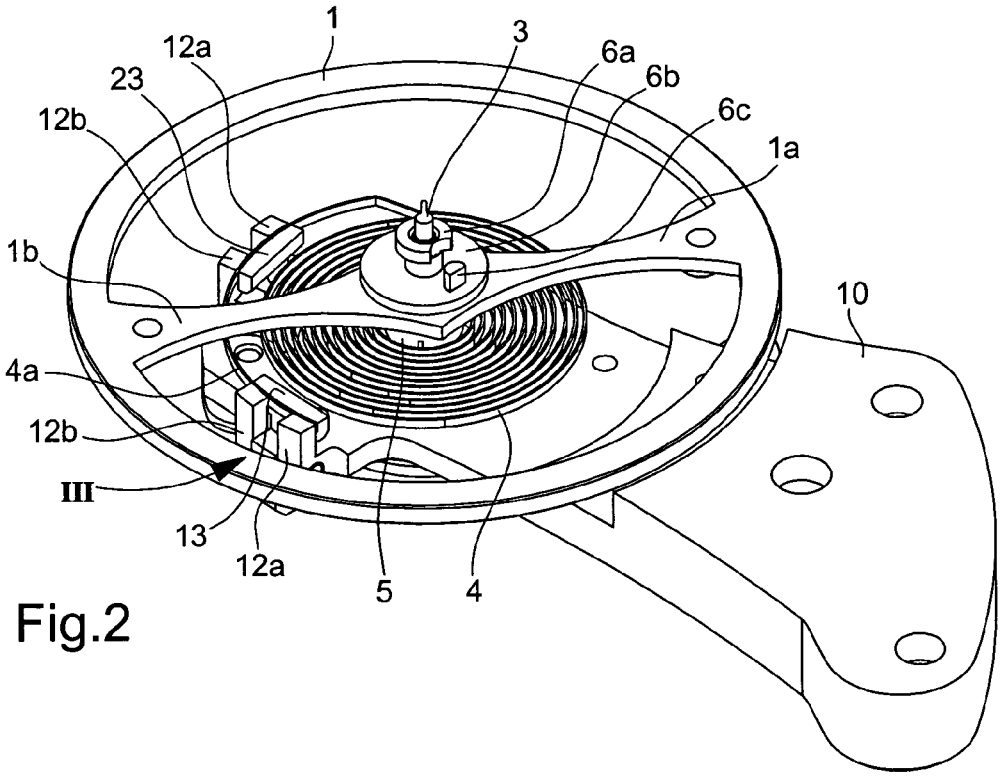
FIG. 2 is a bottom perspective view of the sprung balance shown in FIG. 1.

FIGS. 1 and 2 show perspective, respectively top and bottom views, of a sprung balance according to a first embodiment of the invention, the assembly having to be secured to a plate of a mechanical watch movement (not shown). In this example, the balance 1 comprises two arms 1*a*, 1*b* into which poising screws 2*a*, 2*b* are screwed, its staff 3 being pivoted between a plate (not shown) and a balance cock 10. In a conventional manner, FIG. 2 shows that balance 1 includes a small roller 6*a*, a large roller 6*b* with an impulse pin 6*c*, and that a collet 5 allows the curve at the centre of a balance spring 4 to be fixed to staff 3 of balance 1.

Referring more particularly to FIG. 1, it can be seen that balance cock 10 carries an index 20, friction fitted onto top balance endpiece 10*a* and whose tail 20*a* allows its orientation to be altered owing to a fine adjusting screw 7 pressing on said tail of index 20*a* against the return force of a swanneck shaped spring 8, through one end of which, fixed in balance cock 10 by means of two screws 8*a*, said fine regulating screw 7 passes.

Balance cock 10 includes a first lug 11 provided with a first tightening device forming a clamp. This device is formed by a bent stirrup 12 integral with first lug 11 and whose feet 12*a*, 12*b* extend as far as balance spring 4, and in which an L-shaped rocking element 13 is hinged, which can be operated by a flanged tightening screw 19 to form a clamp used for immobilising the end of the outer curve 4*a* of balance spring 4. The detailed description and operation of this clamp assembly will be disclosed hereinafter.

Likewise, index 20 comprises a second tightening clamp device formed, opposite index tail 20*a*, by an extension 21 prolonged by a bent stirrup 22 in which an L-shaped rocking element is hinged, for clamping a portion of the outer curve 4*a* and thus defining the useful length of balance spring 4 by acting on a second flanged tightening screw 29. Extension 21 further comprises, on one of its sides, an annular tongue 31 extending above a second lug 30 of balance cock 10. Tongue 31 comprises an oblong aperture 32 into which there is screwed a screw 9 for locking index 20 in a determined position after the orientation thereof has been adjusted by means of fine adjusting screw 7.

As can be seen in this embodiment, the three screws 9, 19 and 29 and the two poising screws 2*a*, 2*b* are all accessible from the same side, along a direction parallel to the balance staff.

Figure 3:
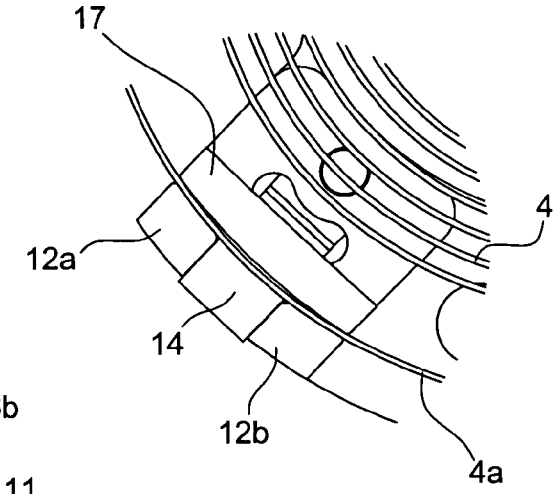
FIG. 3 is an enlarged bottom view of the tightening device along arrow III of FIG. 2.
Figure 4A:
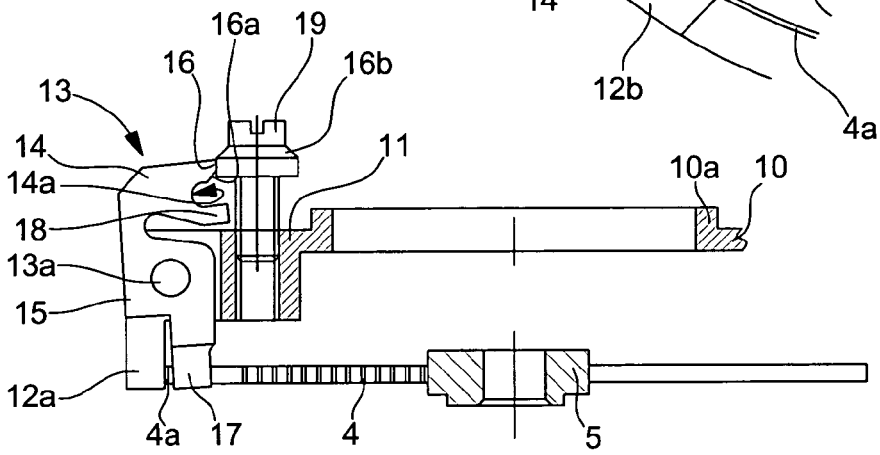
FIGS. 4A and 4B show in cross-section, in an open position and a closed position the tightening device in the balance cock.

The clamps enabling the outer curve 4*a* of the balance spring 4 to be fixed are described with reference also to the partial bottom view of FIG. 3 and to FIG. 4A showing in cross-section, along a line passing through the balance staff, the clamp formed at balance cock 10 by rocking element 13, said clamp being in the open position.

L-shaped rocking element 13 comprises a small arm 14, a large arm 15 and a hinge 13*a* formed, for example, by two studs engaged in corresponding apertures in stirrup 12 of balance cock 10.

Figure 4B:
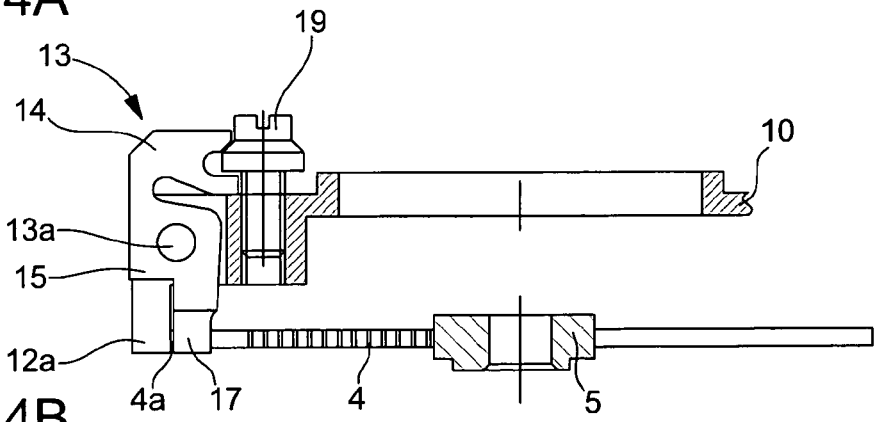

Small arm 14 comprises a notch 14*a* delimited by a top lip 16 and a bottom lip 18. Top lip 16 comprises an inclined plane 16*a* directed towards the interior of notch 14*a*, said inclined plane 16*a* cooperating with an inclined plane 16*b* of tightening screw 19 to pivot rocking element 13, by unscrewing said screw, and opening the clamp. Bottom lip 18 is longer and extends under the flange of tightening screw 19, such that screwing said screw closes the clamp, as shown in FIG. 4B.

Large arm 15 comprises at its base a shoe 17, the ends of which extend on each side facing the inner surface of feet 12*a*, 12*b* of stirrup 12. Shoe 17 and feet 12*a*, 12*b* have the same curvature as the outer curve 4*a* of balance spring 4 such that tightening the clamp does not cause any deformation of the strip of the balance spring 4.

Figure 5:
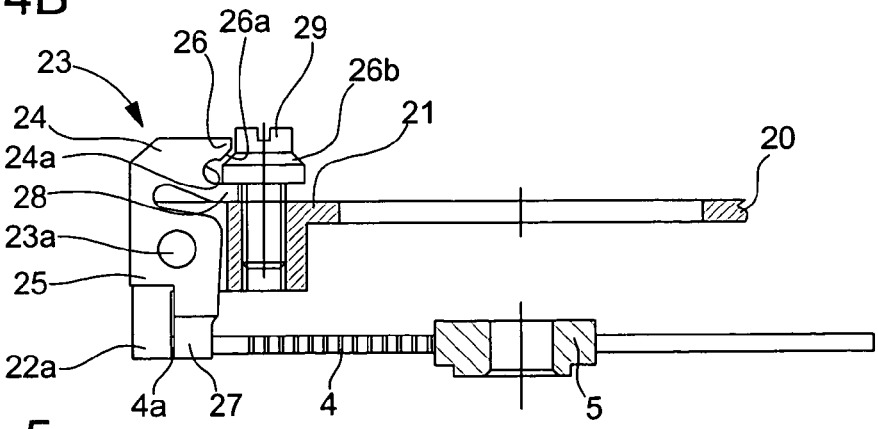
FIG. 5 shows a cross-section of the tightening device in the closed position at the index.
Figure 6:
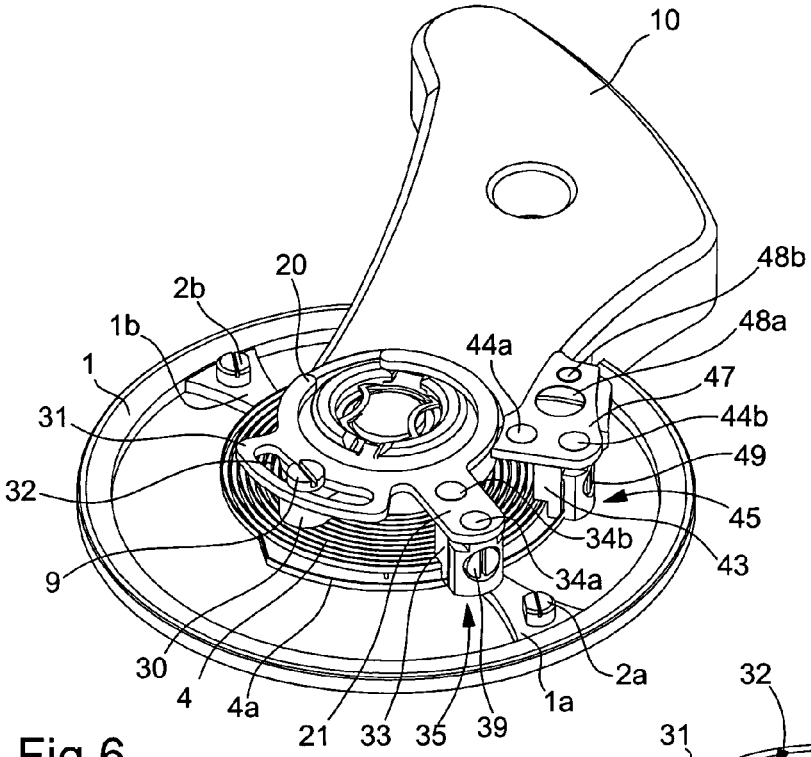
FIG. 6 is a top perspective view of a sprung balance according to a second embodiment of the invention.
Figure 7:
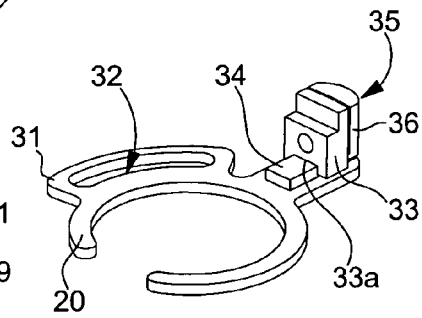
FIG. 7 is a bottom perspective view of the index shown in FIG. 6.
Figure 8:
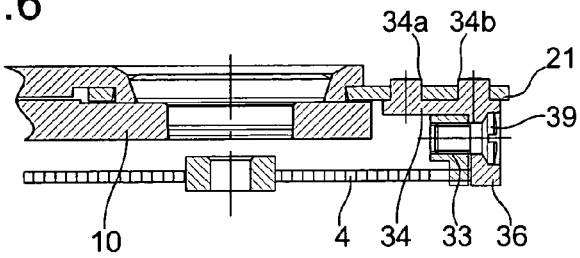
FIGS. 8, 9 and 10 are partial cross-sections along the lines VIII, IX and X of FIG. 6.

The clamp formed at index 20 by rocking element 23, shown in cross-section in the closed position in FIG. 5, has exactly the same features as those previously described. Rocking element 23 operated by flanged tightening screw 29, comprises a small arm 24 with a notch 24*a* delimited by a top lip 26 with an inclined plane 26*a* cooperating with an inclined plane 26*b* of the flange of screw 29, a bottom lip 28 and a large arm 25 that ends, at its base, in a shoe 27 opposite feet 22*a*, 22*b* of stirrup 22.

Owing to the device that has just been described, it is possible to regulate the balance spring by carrying out, in succession, the operations set out hereinafter.

1. Putting into Beat

First of all, screw 19 is unscrewed to open the clamp secured to balance cock 10 and screw 9 is loosened to make a first rough adjustment by rocking index 20. A fine adjustment is then made by manoeuvring screw 7 which acts on index tail 20*a*, then screw 9 and next screw 19 are tightened.

2. Adjustment of the Isochronism

First of all, screw 29 is unscrewed to open the clamp secured to index 20, then screw 9 is loosened. The angle of attachment of balance spring 4 is then altered by manoeuvring fine adjusting screw 7 to optimise the isochronism, then screw 9, and next screw 19 are tightened again.

3. Rough Adjustment

The rate is adjusted by means of poising screws 2*a*, 2*b*, which allow the moment of inertia of the balance to be altered.

4. Fine Adjustment

First of all, screw 29 is unscrewed to open the clamp secured to index 20, then screw 19 is loosened. Acting on screw 7 can then carry out the fine adjustment. In this step, only slight variations in the isochronism can be expected. Finally, first of all screw 9, then screw 29 are tightened again.

As can be seen, with the exception of fine adjustment screw 7, all of the other screws for carrying out the adjustment are accessible from the same side.

With reference now to FIGS. 6 to 10, a second embodiment will be described hereinafter, which differs from that previously described essentially in the way in which the tightening devices are actuated. The common parts, i.e. those that have not undergone any significant modification, will bear the same references and will not be described again.

Figure 9:
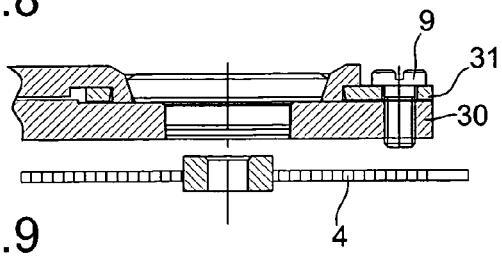
Figure 10:
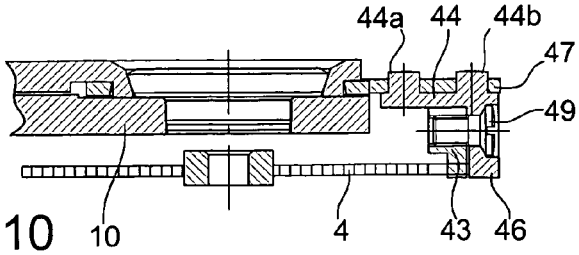

It can be seen first of all that index 20 has the simplified shape of an open ring that no longer comprises an index tail and nor, therefore, the adjusting device which was formed by screw 7 and the swanneck shaped spring 8. It will be observed that such a simplification would be equally applicable to the first embodiment. Index 20 comprises an annular ring 31 provided with an oblong aperture 32 in which there is engaged a screw 9 to be screwed into a lug 30 in balance cock 10 for immobilising index 20 in a given position as can be seen in FIG. 9.

Index 20 also comprises an extension 21 on which there is mounted a tightening device that no longer includes a rocking element, but acts like a vise comprising two jaws 33, 35. An L-shaped fixed jaw 35 includes a small arm 34 fixed to extension 21 by being driven in or riveted by two studs 34*a*, 34*b*, and a large arm 36 through which a conical head screw 39 passes, for manoeuvring a mobile jaw 33 comprising a guide catch 33*a* on small arm 34. By screwing/unscrewing screw 39 in a direction parallel to the plate, it is thus possible to immobilise or release the outer curve of the balance spring 4 to carry out the adjustment operations.

In order to immobilise balance spring 4, a second tightening device forming a vise 45, identical to the first, is mounted on a plate 47 fixed to balance cock 10 by means of a screw 48*a* and a stud 48*b*. As previously, there is thus again a fixed jaw 45, and a mobile jaw 43 assembled via a conical head screw 49, enabling the sprung balance to be easily adjusted.

The operation of this second embodiment is identical to the first, and thus will not be described any further.

Without departing from the scope of the present invention, those skilled in the art can make alterations to the embodiments that have just been described, for example by giving the L-shaped rocking element a different shape or by changing the orientation thereof by 180°.

The invention claimed is:

1. A fine adjusting device for a sprung balance, formed of a balance provided with poising screws, pivoted between a plate and a balance cock supporting an index, and a balance spring, by means of poising screws and tightening devices provided at the balance cock and the index, wherein the balance cock is provided with a first lug comprising a first device tightening the end of the balance spring, said device being formed by a clamp comprising a fixed arm in the shape of a stirrup extending said lug perpendicularly and in which there is hinged an L-shaped rocking element that can be manoeuvred by a flanged screw, wherein the index is provided with an extension comprising a second device tightening the outer curve of the balance spring, said device being identical to the first and able to be manoeuvred by a flanged screw, and wherein the balance cock is provided with a second lug comprising a third tightening device formed by a screw screwed into said lug through an oblong aperture of an annular extension of the index to lock said index in a determined position, the three screws enabling a fine adjustment to be carried out.

2. The adjusting device according to claim 1, wherein each rocking element is formed by a large arm and a small L-shaped arm including a notch delimited by a top lip and a bottom lip, in which the flange of the associated screw engages to open or close the clamp formed by the stirrup and the large arm.

3. The adjusting device according to claim 2, wherein the top lip of the L-shaped rocking element includes a plane inclined towards the notch cooperating with a corresponding inclined plane of the flange of a tightening screw to open the clamp by being unscrewed.

4. The adjusting device according to claim 2, wherein the bottom lip of the L-shaped rocking element is longer than the top lip and extends under the flange of a tightening screw to close the jaw by being screwed in.

5. The adjusting device according to claim 1, wherein a large arm of the L-shaped rocking element ends in a shoe the ends of which abut against the base of the stirrup while having a curvature corresponding to that of the outer curve of the balance spring.

6. The adjusting device according to claims 1, wherein the poising screws of the balance have a cylindrical head with a cut face.

7. The adjusting device according to claims 1, wherein the index is further provided with an index tail able to be manoeuvred by a screw against the force of a return spring.

8. A fine adjusting device for a sprung balance, formed of a balance provided with poising screws, pivoted between a plate and a balance cock supporting an index, and a balance spring, by means of poising screws and tightening devices provided at the balance cock and the index, wherein the index is provided with a first lug in which there is fixed a first device tightening the outer-curve of the balance spring, said device being formed by a vise comprising a fixed jaw secured to the first lug and a mobile jaw that can be manoeuvred by a conical head screw, and wherein the balance cock is provided with a second device for tightening the end of the balance spring, said device being identical to the first and fixed in a plate secured to the balance cock and able to be manoeuvred by a conical head screw and wherein the balance cock is provided with a second lug including a third tightening device formed by a screw screwed into said lug through an oblong aperture of an annular extension of the index to lock said index in a determined position, the three screws enabling a fine adjustment to be carried out.

* * * * *